US011846081B2

(12) United States Patent
Molyneux

(10) Patent No.: US 11,846,081 B2
(45) Date of Patent: Dec. 19, 2023

(54) TRENCH SHORING APPARATUS AND ITS METHOD OF USE

(71) Applicant: SECURE GROUND SOLUTIONS LTD, Chester (GB)

(72) Inventor: Glenn Molyneux, Neston (GB)

(73) Assignee: Secure Ground Solutions LTD, Chester (GB)

( * ) Notice: Subject to any disclaimer, the term of this patent is extended or adjusted under 35 U.S.C. 154(b) by 0 days.

(21) Appl. No.: 17/298,568

(22) PCT Filed: Nov. 29, 2019

(86) PCT No.: PCT/GB2019/053384
§ 371 (c)(1),
(2) Date: May 29, 2021

(87) PCT Pub. No.: WO2020/115460
PCT Pub. Date: Jun. 11, 2020

(65) Prior Publication Data

US 2022/0018082 A1 Jan. 20, 2022

(30) Foreign Application Priority Data

Dec. 5, 2018 (GB) ..... 1819830

(51) Int. Cl.
*E02D 17/08* (2006.01)

(52) U.S. Cl.
CPC ..... *E02D 17/083* (2013.01); *E02D 2600/20* (2013.01)

(58) Field of Classification Search
CPC ... E02D 17/083; E02D 17/0836; E02D 17/08; E02D 17/04
See application file for complete search history.

(56) References Cited

U.S. PATENT DOCUMENTS 2,482,367 A * 9/1949 Ravers, Jr. ..... E02D 17/086 405/282
3,263,430 A * 8/1966 Bryan ..... E02D 17/083 405/282
4,199,278 A * 4/1980 Koehl ..... E02D 17/08 405/282
4,247,222 A 1/1981 Schosek
4,274,758 A * 6/1981 Schosek ..... E02D 17/08 175/62
4,279,548 A * 7/1981 Ramey ..... E02D 17/086 37/189

(Continued)

FOREIGN PATENT DOCUMENTS

FR 1535655 A 8/1968
JP S525912 A 1/1977

*Primary Examiner* — Benjamin F Fiorello
(74) *Attorney, Agent, or Firm* — Craft Chu PLLC; Andrew W. Chu

(57) ABSTRACT

The trench shoring apparatus includes first and second side panels connected in a parallel spaced-apart configuration by a connecting rod pivotally connected to one end of one or more pairs of lateral arms. The other opposite end of the one or more pairs of lateral arms is hingedly connected to the side panels, such that translational movement of the connecting rod in a direction parallel to the side panels causes the spaced-apart panels to move between retracted and extended parallel spaced-apart configurations.

20 Claims, 9 Drawing Sheets

(56) References Cited

U.S. PATENT DOCUMENTS

| | | | | |
|---|---|---|---|---|
| 4,370,079 | A * | 1/1983 | Pizzirani | B66C 1/66 405/272 |
| 7,021,868 | B1 * | 4/2006 | Farrag | E02D 17/00 160/213 |
| 2002/0192034 | A1 | 12/2002 | Kondo et al. | |
| 2008/0219777 | A1 * | 9/2008 | Thompson | E02D 9/02 405/282 |
| 2010/0034597 | A1 * | 2/2010 | Kundel, Sr. | E02D 17/08 405/283 |
| 2011/0305528 | A1 * | 12/2011 | Riggle, Jr. | E02D 17/086 405/283 |
| 2017/0002538 | A1 * | 1/2017 | Parker | E02D 17/086 |
| 2018/0209114 | A1 * | 7/2018 | Foley | E02D 17/083 |

* cited by examiner

TRENCH SHORING APPARATUS AND ITS METHOD OF USE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention relates to a trench shoring apparatus and its method of use. In particular, this invention relates to a trench shoring apparatus that can be quickly and easily deployed to provide a temporary earth retaining structure which prevents the excavated sides of a trench from collapse.

2. Description of Related Art Including Information Disclosed Under 37 CFR 1.97 and 37 CFR 1.98.

The skilled person will appreciate that with most forms of residential, commercial and light industrial property construction, the first stages of the work generally involve ground preparation and levelling of the site, prior to excavation of trenches or ditches that ultimately form the foundation footings of the property. Equally, earth excavations can be needed for the installation of pipelines, structures and water, drainage, sewerage, gas and other sub-surface utilities. Work of this nature is usually carried out using heavy construction equipment, such as excavators or diggers.

Depending upon the soil and environmental conditions, there is often the risk of the vertical or near vertical sides of the excavation collapsing into the trench, which not only requires significant rework, introducing associated delays and costs, but more importantly, this presents a danger to construction workers and other personnel working on, or near, the excavation site.

In order to address this problem, builders and construction or utilities workers can sometimes use trench boxes which generally comprise a simple two-sided support system. These are normally constructed with side walls of varying thicknesses and which are held apart by steel or aluminium props, jacks or spreaders. In addition to commercial trench boxes, workers often construct ad hoc structures, made up of boarding to contact the excavated sides of the trench and utilising anything to hand that can act as a prop or jack, which by their very nature are not particularly stable or secure. Commercial trench boxes available in the marketplace, are also time consuming to install, often requiring the construction or utilities worker to enter the trench, with the associated risk of death or injury from a cave-in or collapse.

It is an object of the present invention to provide a trench shoring apparatus and its method of use which overcomes or reduces the drawbacks associated with known products of this type, or other ad hoc shoring structures. It is a further object of the present invention to provide a trench shoring apparatus that can be quickly and easily deployed to provide a temporary earth retaining structure which prevents the excavated sides of trenches or ditches from cave-in or collapse. The insertion and deployment of the trench shoring apparatus of the present invention being at all times from above the surface of the trench and requiring no work inside the trench. It is a further object of the present invention to provide a trench shoring apparatus that can be deployed without the use of hand tools and which occurs automatically using a pivoting hinge mechanism as the trench shoring apparatus is lowered into the bottom of the trench, such that the space between the side walls of the trench and the side panels of the apparatus are taken up automatically. It is a further object of the present invention to provide a trench shoring apparatus that can be quickly retrieved from the trench after use, again without the need for a worker to enter, reach or lean into the trench or ditch.

BRIEF SUMMARY OF THE INVENTION

The present invention is described herein and in the claims.

According to the present invention there is provided a trench shoring apparatus, comprising:

first and second side panels connected in a parallel spaced-apart configuration by a connecting rod pivotally connected to one end of one or more pairs of lateral arms, the other opposite end of the one or more pairs of lateral arms being hingedly connected to the side panels, such that translational movement of the connecting rod in a direction parallel to the side panels causes the spaced-apart panels to move between retracted and extended parallel spaced-apart configurations.

An advantage of the present invention is that it can be used to quickly and securely provide a temporary earth retaining structure which prevents the excavated sides of a trench or ditch from collapse. The deployment and subsequent retrieval of the trench shoring apparatus being at all times from above the surface of the trench, and requiring no work inside the trench.

Preferably, the first and second side panels are planar and each having an inner and outer surface.

Further preferably, the outer surfaces of the first and second side panels abut with the excavated sides of the trench when in use.

In use, the inner surfaces of the first and second side panels may be each connected to a plurality of elongate support members positioned from the top to the bottom of the side panels.

Preferably, the elongate support members are each secured to the inner surfaces of the first and second side panels using threaded fasteners which are received through apertures formed in the side panels and in the support members.

Further preferably, the first and second panels are formed from a material selected from the group consisting, but not limited to, any one of the following: treated plywood, aluminum, sheet steel, durable plastics material and the like.

In use, the retracted configuration may have a lateral dimension which is less than the width of the trench into which the apparatus is inserted when in use and which is less than the width of the extended configuration.

Preferably, the elongate support members form a fixed part of a hinge connection and having a generally square cross section with a pair of panels disposed either side thereof.

Further preferably, the pairs of lateral arms form a moving part of the hinge connection, the pairs of lateral arms further comprising triangular upper and lower hinge plates disposed towards the top and near the middle respectively of the trench shoring apparatus.

In use, the upper and lower hinge plates may be identical in size and shape.

Preferably, the upper hinge plate includes an elongated slot disposed along the top edge of the upper hinge plate, the slot securing a grille thereto using grille anchors.

Further preferably, the upper and lower hinge plates each include a proximal aperture for receiving an elongate bar running the length of the side panels to permit pivotal movement of the upper and lower hinge plates relative to the support members.

In use, the pivotal movement of the upper and lower hinge plates may be only possible in an upward direction as a side edge of the upper and lower hinge plates abuts against the inner surface of the side panels preventing movement in a downward direction.

Preferably, the upper and lower hinge plates are received in pairs along each side face of the support members.

Further preferably, one or more connecting rods are disposed between the two pairs of upper and lower hinge plates.

In use, the connecting rods may be elongate rods having apertures at each end thereof which meet with distal apertures disposed on the upper and lower hinge plates for receiving a top spacer bar and an elongate bar respectively.

Preferably, two or more hoisting loops disposed along the top spacer bar, the hoisting loops being received within slots disposed in the pair of grilles.

Further preferably, the pair of grilles are positioned either side of the top spacer bar.

In use, the trench shoring apparatus may further comprise a plurality of feet disposed at the bottom of the trench shoring apparatus and opposite to the upper facing grilles, each of the feet having legs which are received inside the cross section of each support member.

Preferably, the feet are adjustable in height using threaded fasteners which are received through apertures in the legs and corresponding apertures in the support members.

Further preferably, the trench shoring apparatus further comprises retrofittable extension boards or shims being placed on the outer surfaces of the side plates to further extend the lateral dimensions of the apparatus.

In use, the trench shoring apparatus may further comprise rollers or other support means being positioned on the top edge of the lower hinge plate to support utilities or temporary pipework running through the trench when in use.

Preferably, the lateral arms each further comprise complementary shaped elongate adjustable struts disposed towards the top and near the middle of the trench shoring apparatus.

Further preferably, the adjustable struts are each formed having a box-section construction.

In use, the complementary shaped elongate adjustable struts may comprise an inner strut which can be entirely received within the body of an outer strut.

Preferably, the adjustable strut being telescopically extendable and retractable, and locked in position by locating an adjustment pin in one of a plurality of apertures which are formed in the inner and outer struts.

Further preferably, the proximal end of the outer strut includes a proximal aperture for receiving a pin that is disposed between each side face of the backplate to permit pivotal movement of the adjustable strut.

In use, the proximal end of the inner strut may include a proximal aperture for receiving a pin that is pivotally connected to the connecting rod.

Preferably, the pivotal movement of the adjustable struts being only possible in an upward direction as the lowermost face of the outer strut abuts against a stopper plate preventing movement in a downward direction.

Further preferably, the connecting rod is disposed between the two pairs of adjustable struts.

In use, the durable plastics material may comprise Polypropylene (PP), High-Density Polyethylene (HDPE), Polyethylene Terephthalate (PET), Polyvinyl Chloride (PVC) or Acrylonitrile Butadiene Styrene (ABS) or blends thereof.

Preferably, the trench shoring apparatus further comprises connectors which meet with appropriate fasteners on groundmats and the like.

Further preferably, the metalwork components forming the apparatus are selected from a material from the group consisting, but not limited to, any one of the following: mild, powder-coated or galvanised steel, or aluminium and the like.

Also according to the present invention there is provided a method of supporting the side walls of an excavated trench using the trench shoring apparatus as hereinbefore described, the method comprising the steps of:

- coupling a sling adjacent the connecting rod of the trench shoring apparatus;
- hoisting the apparatus thereby causing the spaced-apart panels to move to the retracted spaced-apart configuration;
- lowering the retracted apparatus into the excavated trench; and
- pushing the connecting rod downwards such that the side panels splay apart into the extended spaced-apart configuration to abut against the side walls of the excavated trench.

It is believed that a trench shoring apparatus and its method of use in accordance with the present invention at least addresses the problems outlined above.

It will be obvious to those skilled in the art that variations of the present invention are possible and it is intended that the present invention may be used other than as specifically described herein.

BRIEF DESCRIPTION OF THE SEVERAL VIEWS OF THE DRAWINGS

The present invention will now be described by way of example only, and with reference to the accompanying drawings.

DETAILED DESCRIPTION OF THE INVENTION

The present invention has adopted the approach of utilising a trench shoring apparatus that can be quickly and easily deployed to provide a temporary earth retaining structure which prevents the excavated sides of trenches or ditches from cave-in or collapse. Advantageously, the insertion and deployment of the trench shoring apparatus of the present invention being at all times from above the surface of the trench and requiring no work inside the trench. Further advantageously, the present invention provides a trench shoring apparatus that can be deployed without the use of hand tools and which occurs automatically using a pivoting hinge mechanism as the trench shoring apparatus is lowered into the bottom of the trench, such that the space between the side walls of the trench and the side panels of the apparatus are taken up automatically. Further advantageously, the present invention provides a trench shoring apparatus that can be quickly retrieved from the trench after use, again without the need for a worker to enter, reach or lean into the trench or ditch.

Figure 1:
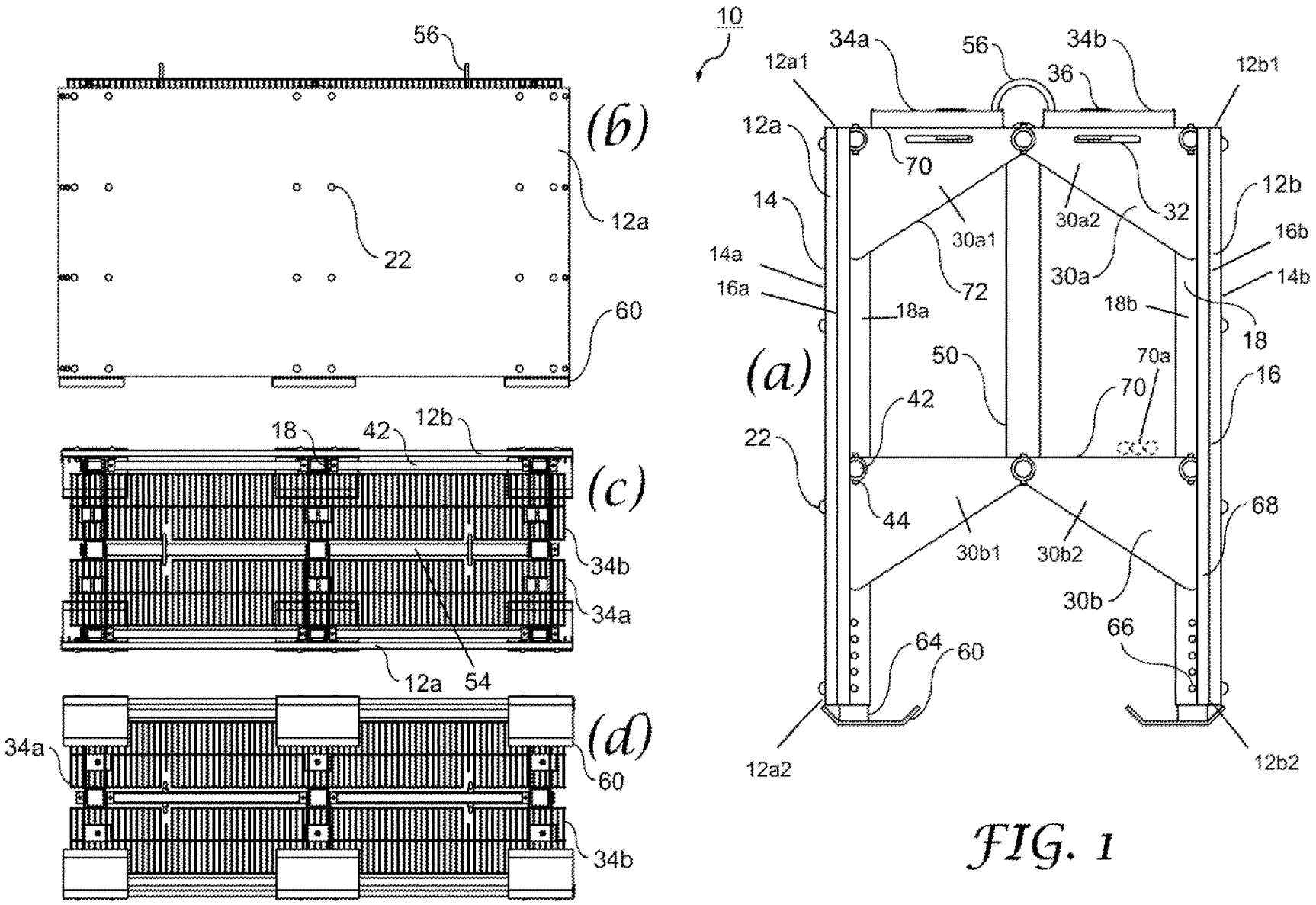
FIG. 1 is an isometric view of a trench shoring apparatus in accordance with the present invention.
Figure 2:
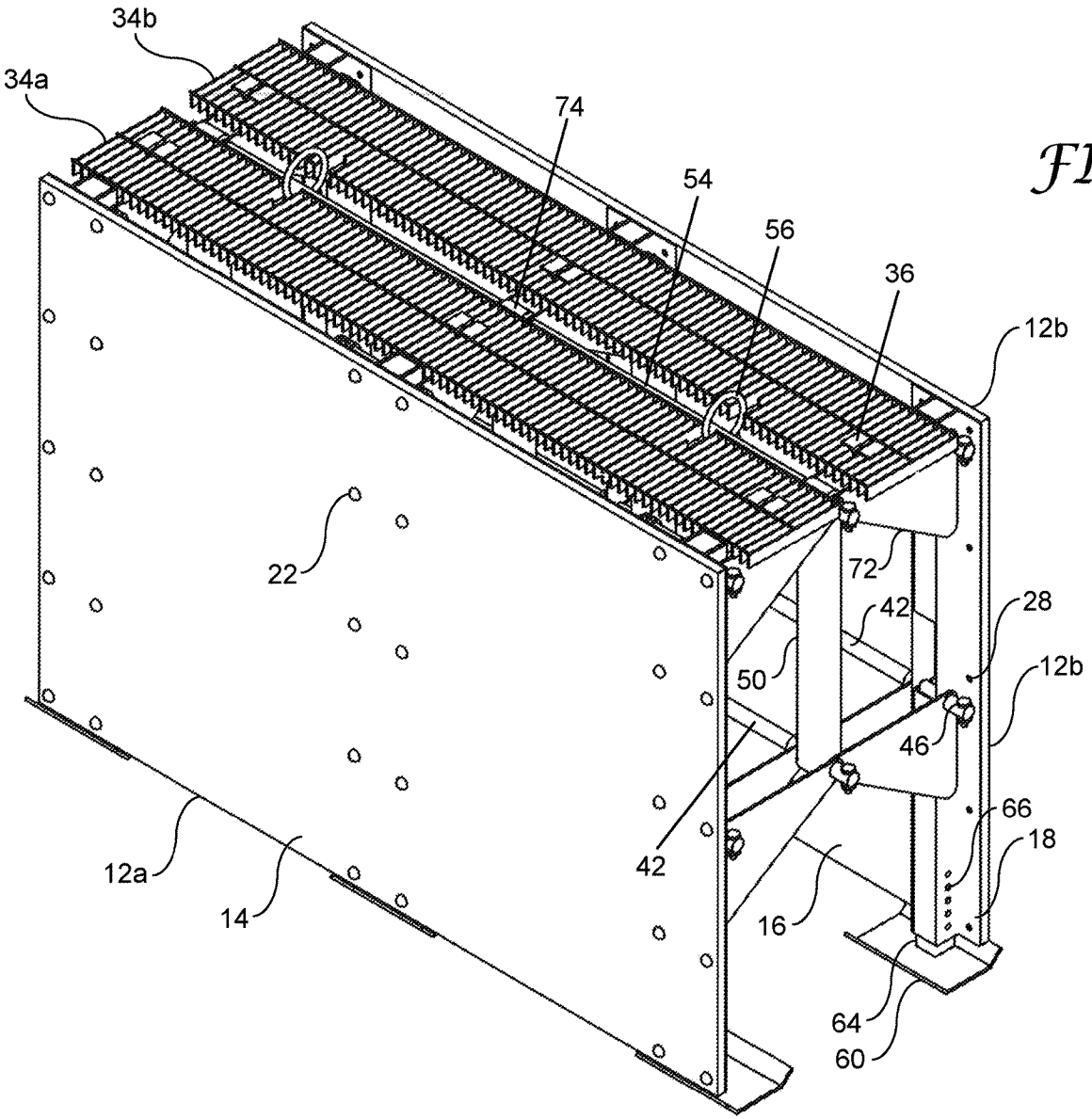
FIG. 2 shows a perspective view from the side and above of the trench shoring apparatus of FIG. 1 in a deployed configuration.
Figure 3:
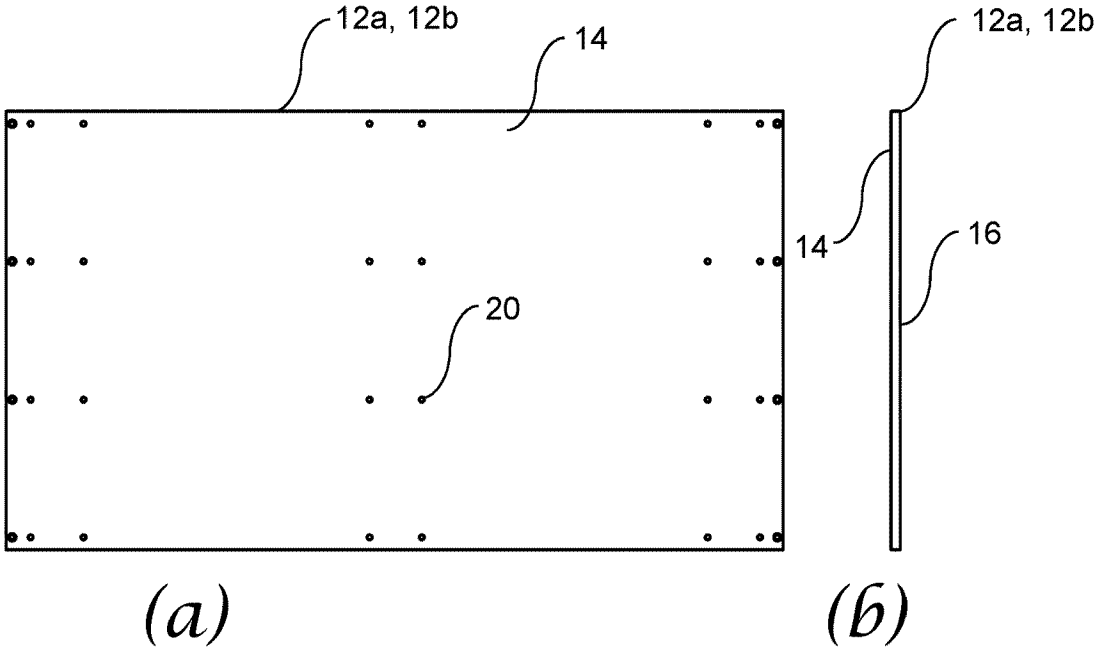
FIG. 3 illustrates front and side plan elevation views respectively of the side panel of the trench shoring apparatus.
Figure 4:
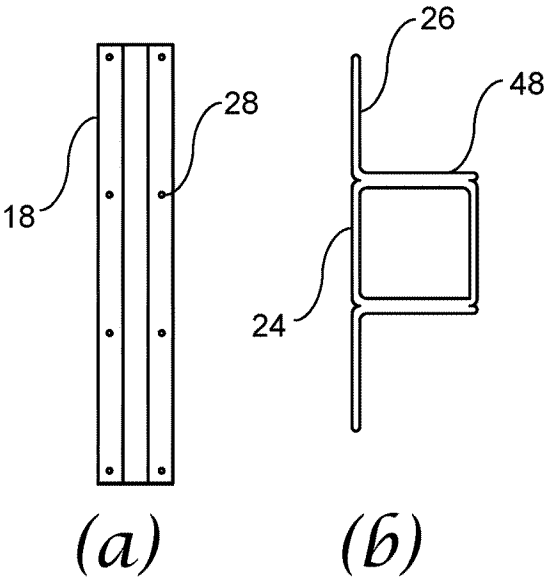
FIG. 4 is front and top plan elevation views respectively of the backplate positioned on the inner face of the side panels.

Referring now to the drawings, a trench shoring apparatus 10 according to the present invention is illustrated in FIGS. 1 and 2. FIGS. 1*a*, 1*b*, 1*c* and 1*d* show side, front, top and bottom views of the trench shoring apparatus 10 respectively, and FIG. 2 shows a perspective view thereof when deployed.

As perhaps best shown in FIG. 1*a*, the trench shoring apparatus 10 is formed having first and second panels 12*a*, 12*b* held in a parallel spaced-apart configuration. The panels 12*a*, 12*b* are planar, each having an outer 14 and inner surface 16 (a first side panel 12a having a first top side panel edge 12a1, a first bottom side panel edge 12a2, a first inner surface 16a and a first outer surface 14a; a second side panel 12b having a second top side panel edge 12b1, a second bottom side panel edge 12b2, a second inner surface 16b and a second outer surface 14b). When the apparatus 10 is deployed in a trench (not shown), it is the outer surface 14b). When the apparatus 10 is deployed in a trench (not shown), it is the outer surface 14 of the panels 12*a*, 12*b* that are in contact with the excavated sides of the trench or ditch to prevent a cave-in or collapse. In a preferred embodiment of the invention, the first and second panels 12*a*, 12*b* are formed from treated plywood and the like. The inner surface 16 of the panels 12*a*, 12*b* is connected to a plurality of elongate backplates or support elongate member 18 (a first support elongate member 18a, a second support elongate member 18b) which are positioned from the top to the bottom of the side panels 12*a*, 12*b*, as best shown in FIG. 2. The backplates 18 are secured to the panels 12*a*, 12*b* through apertures 20 formed in the side panels 12*a*, 12*b* and secured using threaded fasteners 22 which meet with complementary apertures 28 disposed along the length of the backplate 18, as shown in FIGS. 1 to 4.

The skilled person will appreciate that, when in use, the side panels 12*a*, 12*b* can be replaced quickly and easily because of wear and tear and/or damage from contact with the excavated sides of the trench or ditch. Alternatively, the side panels 12*a*, 12*b* can be formed from an aluminium or steel sheet material and the like, and the above is in no way intended to be limiting.

The first and second side panels 12*a*, 12*b* are connected in a parallel spaced-apart configuration and the spaced-apart panels 12*a*, 12*b* are able to move between extended and retracted spaced-apart parallel configurations when being deployed in, or retrieved from, a trench (not shown). It will be appreciated that within this application, the term "extended configuration" means a spaced-apart parallel configuration of the side panels 12*a*, 12*b* in which the outer surfaces 14 of the side panels 12*a*, 12*b* abut against the side walls of the excavated trench. The term "retracted configuration" means a thinner spaced-apart lateral configuration or dimension between the side panels 12*a*, 12*b*. The retracted configuration has a spaced-apart dimension which is less than the extended configuration, and critically less than the width of the trench or ditch into which the apparatus 10 is to be deployed. Movement of the side panels 12*a*, 12*b* between retracted and extended spaced-apart configurations is via a pivoting hinge mechanism, as described below.

Disposed along the length of the inner surfaces 16 of the side panels 12*a*, 12*b* are the plurality of backplates 18. The backplates 18 form a fixed part of a hinge mechanism having a generally square cross section 24 with a pair of panels 26 either side of the central structural section 24. The panels 26 include a series of pre-drilled apertures 28. It is through these apertures 28 that the backplate 18 is secured to the inner surface 16 of the side panels 12*a*, 12*b*, as perhaps best shown in FIG. 2.

Figure 12:
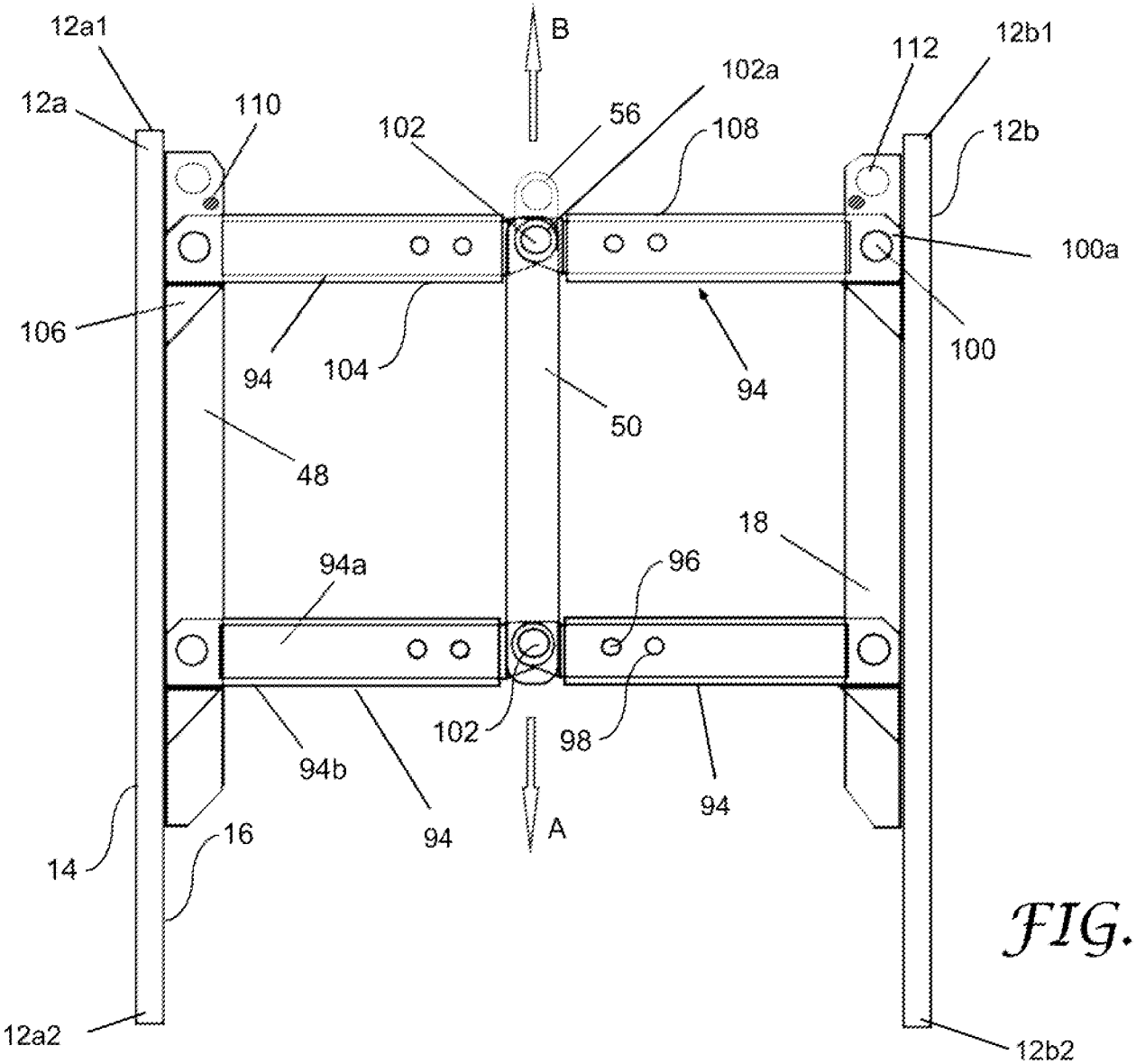
FIG. 12 is a side plan elevation view of a second embodiment of the present invention and shows the trench shoring apparatus in an extended configuration.

Pivotally connected to the backplate 18 is the moving part of the hinge mechanism and being provided by hinge plates 30*a*, 30*b* or pair of lateral arms (upper hinge plates 30*a*, first upper hinge plate 30*a*1, second upper hinge plate 30*a*2, lower hinge plates 30, first lower hinge plate 30*b*1, second lower hinge plate 30*b*2, struts 94), disposed towards the top and near the middle respectively of the trench shoring apparatus 10, as shown in FIG. 1*a* and 2. In particular, an upper support plate 30*a* is disposed towards the top section of the apparatus 10 and a lower hinge plate 30*b* disposed nearer the middle section of the apparatus 10. FIG. 1*a* shows a pair of lateral arms as the first upper hinge plate 30*a*1 and the second upper hinge plate 30*a*2 and another pair of lateral arms as the first lower hinge plate 30*b*1 and the second lower hinge plate 30*b*2. FIG. 2 shows a first additional pair of lateral arms and a second additional pair of lateral arms. FIG. 12 shows a first alternative additional pair of lateral arms and a second alternative additional pair of lateral arms.

Figure 5:
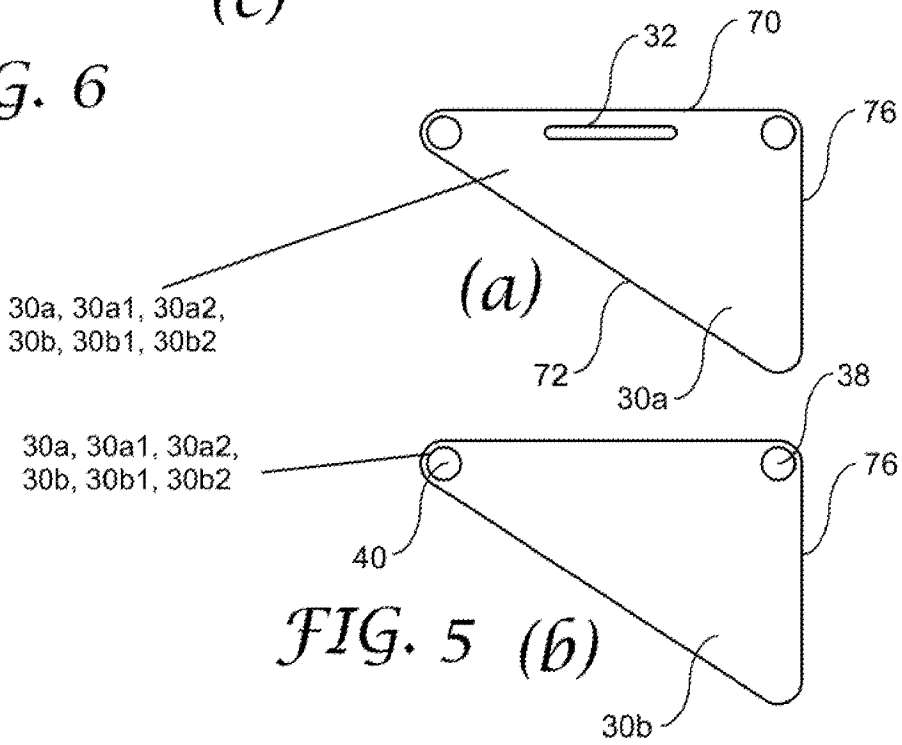
FIG. 5 shows front plan elevation views of the top and bottom hinge plates respectively of the trench shoring apparatus of FIG. 1.
Figure 7:
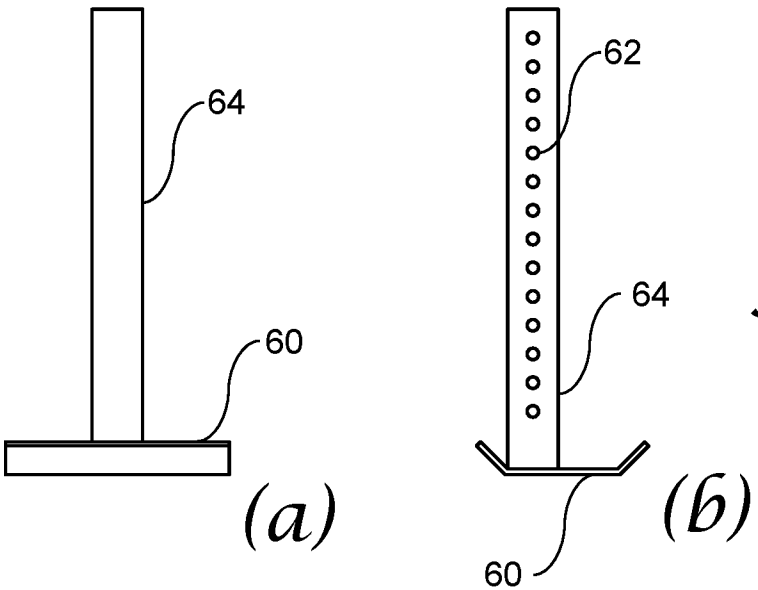
FIG. 7 shows front and side plan elevation views respectively of the adjustable feet of the trench shoring apparatus of FIG. 1.

Further detail of the triangular hinge plates 30*a*, 30*b* is shown in FIG. 5. The upper and lower hinge plates 30*a*, 30*b* are identical in size and shape apart from the fact that the upper hinge plate 30*a* includes an elongated slot 32 disposed along the top edge 70 of the hinge plate 30*a*. It is through this slot that a grille 34 located towards the top of the apparatus 10 is secured through grille anchors 36. When deployed in the trench, the grille 34 provides a temporary flat surface for trafficking and wheeled access, as shown in FIG. 2.

The upper and lower hinge plates 30*a*, 30*b* each include a proximal aperture 38 which receives an elongate bar 42 running the length of the side panels 12*a*, 12*b*, as perhaps best shown in FIGS. 1 and 2. The ends of the elongate bars 42 are secured using spring tension pins or Sellock pins 44 (as shown in FIG. 1), or a threaded fastener 46 (as depicted in FIG. 2). The skilled person will appreciate that such a configuration permits pivotal movement of the upper and lower hinge plates 30*a*, 30*b* relative to the backplate 18 in an upward direction only, since the side edge 76 of the upper and lower hinge plates 30*a*, 30*b* abuts against the inner surface 16 of the side panels 12*a*, 12*b* preventing movement in a downward direction.

Figure 6:
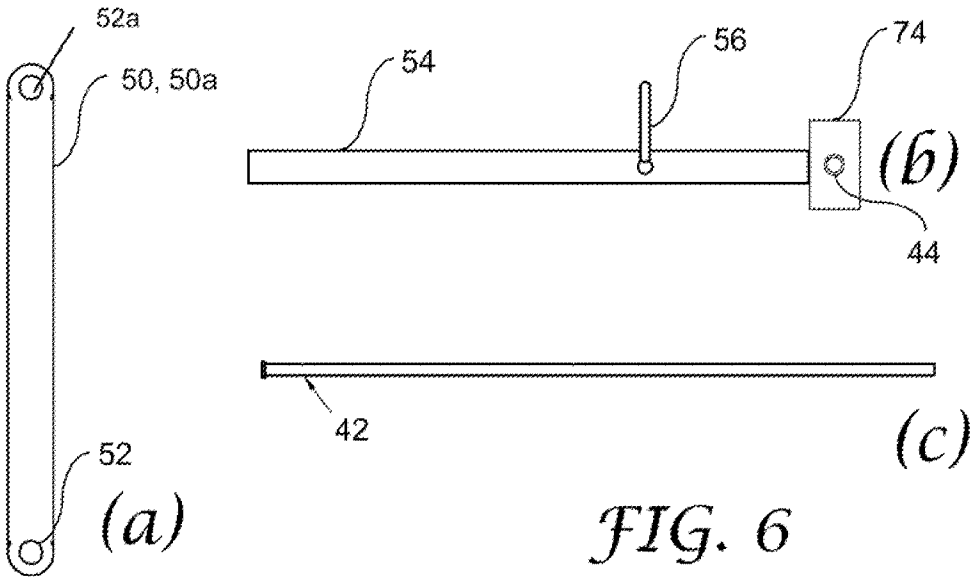
FIG. 6 illustrates a side plan elevation view of the connecting rod used in the trench shoring apparatus of FIG. 1 and side plan elevation views of the bars respectively of the trench shoring apparatus of FIG. 1.

The upper and lower hinge plates 30*a*, 30*b* are received in pairs along each side face 48 of the backplate 18. Disposed between the two sets of upper and lower hinge plates 30*a*, 30*b* are a series of connecting rods (connection rod 50, additional connecting rod 50*a*) as best shown in FIG. 6*a*. The connecting rods 50 are elongated rods having apertures 52 at each end thereof (end apeture 52*a*, opposite end aperture 52) which meet with distal apertures 40 disposed on the hinge plates 30*a*, 30*b* for receiving a top spacer bar 54 and an elongate bar 42 respectively.

Figure 8:
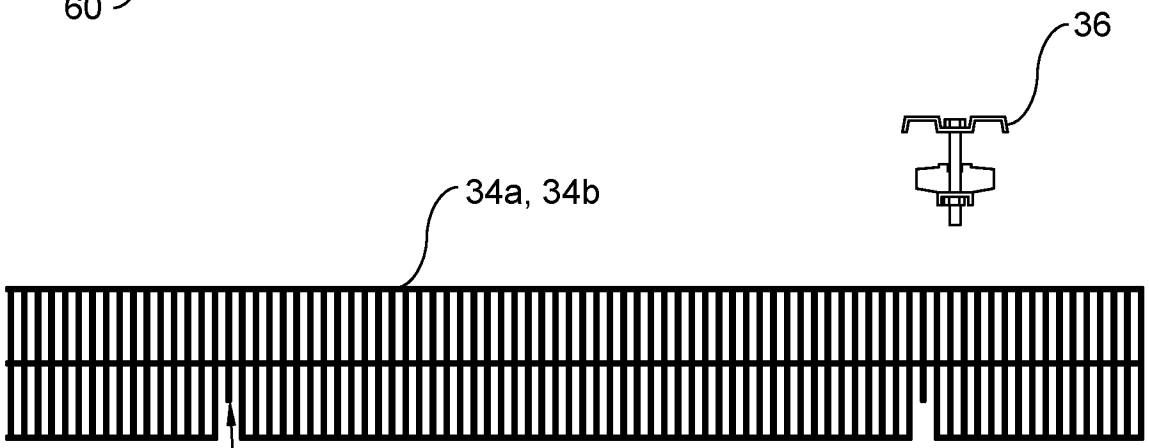
FIG. 8 is a top plan view of the grille located at the top of the trench shoring apparatus of FIG. 1.

The top spacer bar 54 is assembled from two complementary shaped pieces, which are secured using a collar 74. Disposed at two points in the top section of the grille 34*a*, 34*b* are two hoisting loops 56. The hoisting loops 56 sit within slots 58 disposed in each of the grilles 34*a*, 34*b*, as shown in FIGS. 2 and 8.

At the bottom of the trench shoring apparatus 10, opposite to the uppermost facing grilles 34*a*, 34*b* are a series of feet 60 having legs 64 which are received inside the cross section 24 of the backplate 18. The feet 60 can be adjusted in height via apertures 62 which meet with corresponding apertures 66 in the backplate 18 and secured using threaded fasteners and the like (not shown).

The skilled person will appreciate that when deployed, the trench shoring apparatus 10 comprises a box-shaped structure, the side panels 12*a*, 12*b* of which can be used to contact or abut against the excavated sides of trenches or ditches to prevent cave-ins or collapse.

The pivoting hinge mechanism formed by the pivotal connection of the backplate 18, hinge plates 30*a*, 30*b* and connecting rod 50 is such that movement of the connecting rod 50 in a direction parallel to the side panels 12*a*, 12*b* causes the spaced-apart panels 12*a*, 12*b* to move between an extended parallel spaced-apart configuration for deployment in a trench, and a retracted parallel spaced-apart configuration for insertion into the trench.

The metalwork components forming the apparatus 10 can be mild, powder-coated or galvanised steel, or aluminium and the like.

As shown in FIG. 1*a* (not depicted in FIG. 2), a U-shaped channel 68 runs from the top of the side panels 12*a*, 12*b* to the bottom of the side panel 12*a*, 12*b* and disposed on the inner surface 16 thereof. In to this U-shaped channel, a separate board (not shown) can be inserted to completely close off the trench shoring apparatus 10, when deployed in the trench, as detailed below.

The use of the present invention will now be described.

Typically, an open trench or ditch is excavated using an excavator, as mentioned above. Depending primarily upon the soil substrate and the weather conditions this open trench is at a risk of collapse or cave-in. To shore the trench, the trench shoring apparatus 10 of the present invention can be utilised, which enables a much quicker and secure shoring to be carried out by construction or utilities workers without the need to enter, lean or reach into the excavated trench or ditch.

To shore the excavated trench or ditch, the operator of the excavator connects a length of chain or other flexible sling (not shown) onto the pair of hoisting loops 56 disposed at the top of the apparatus 10. The length of chain is then connected or wrapped around the bucket or dipper arm such that the trench shoring apparatus 10 can be hoisted clear of the ground. In doing so, the translational movement of the connecting rod 50 in a direction parallel to the side panels 12*a*, 12*b* causes the spaced-apart panels 12*a*, 12*b* to move to a retracted spaced-apart configuration whereby the apparatus 10 can be inserted in the trench. The retraction being limited by the hypotenuse edge 74 of the hinge support plates 30*a*, 30*b* which abut against each other.

In this way, the hoisted apparatus 10 can then be lowered into the trench or ditch and the bucket of the excavator used to push down on the top of the grille 34*a*, 34*b* to then splay the spaced-apart side panels 12*a*, 12*b* apart into the extended configuration such that they abut against the side walls of the excavated trench or ditch. In this way, the deployed apparatus 10 acts to shore the trench or ditch without needing to enter the trench or ditch or lean into it, which is a much safer and quicker means of providing temporary support. In this configuration, the grille 34*a*, 34*b* at the top of the trench shoring apparatus 10 can be trafficked and indeed can take the weight of various industrial equipment, such as an excavator, which is able to traverse the trench without risk of collapse.

When it is needed to remove the apparatus 10, the above method is followed in reverse and the apparatus 10 lifted out cleanly without causing any damage to the walls of the excavated trench.

Figure 9:
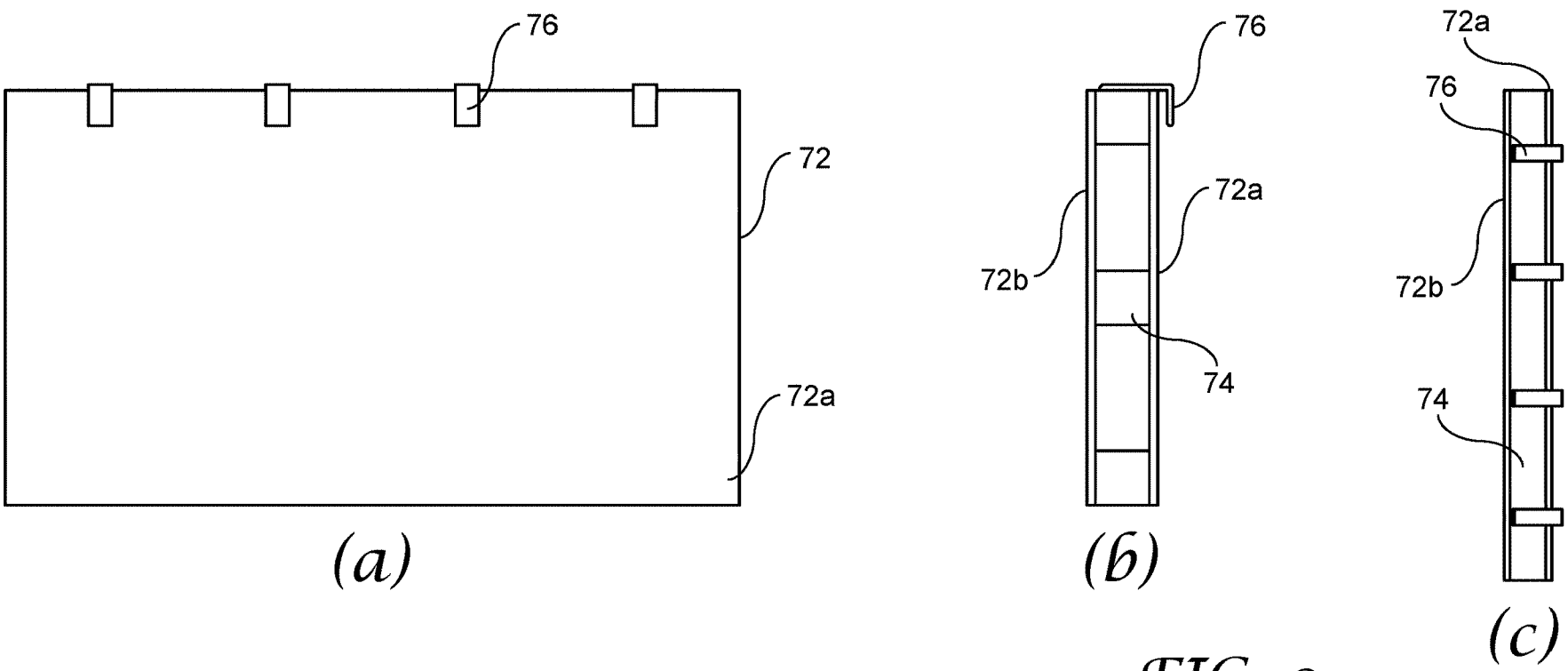
FIG. 9 illustrates front, side and top elevation views respectively of an extension board that can be placed on the outer surface of one or both of the side panels of the trench shoring apparatus to extend its lateral dimension when in use.

The apparatus 10 of the present invention can also be implemented using the following components which may be needed to take-up differences in trench sizes etc., and to further preserve the ground adjacent to the excavated trench. FIGS. 9*a*, 9*b* and 9*c* show front, side and top views respectively of an extension board 72 that can be placed on the outer surface 14 of one or both of the side panels 12*a*, 12*b* to extend the lateral dimension of the deployed apparatus 10 when in use. The extension board or shim 72 is formed from a pair of boards 72*a*, 72*b* that are connected in a parallel spaced-apart configuration either side of a series of ribs 74 which span the length of the boards 72*a*, 72*b*.

Disposed at the top of the assembled board 72 are a series of hooks or connectors 76 that permit the board 72 to be simply slotted onto the top of one or both of the side panels 12*a*, 12*b* should the lateral dimension of the apparatus 10 need to be extended. As perhaps best shown in FIG. 9*b*, the hook 76 can receive panel 12*a* or 12*b* such that the outer surface 14 of panel 12, 12*b* abuts against the outer surface of board 72*a*, and it is the outer surface of board 72*b* which contacts the excavated side of the trench when deployed.

The materials forming the extension board 72 and ribs 74 being a recycled durable plastics material or the like.

Figure 10:
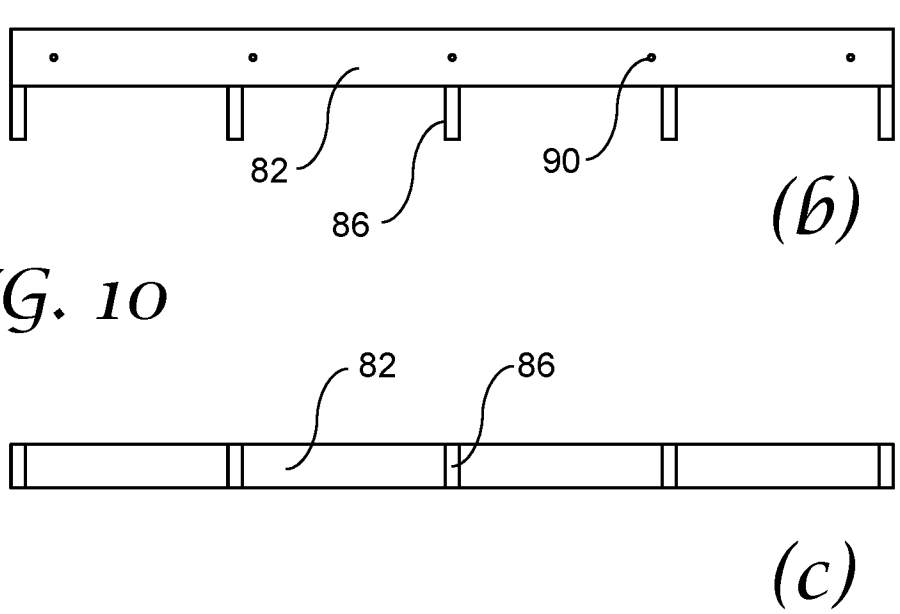
FIG. 10 shows schematic views of how the present invention can be implemented using at least one an apron clamp which receives an apron board.
Figure 11:
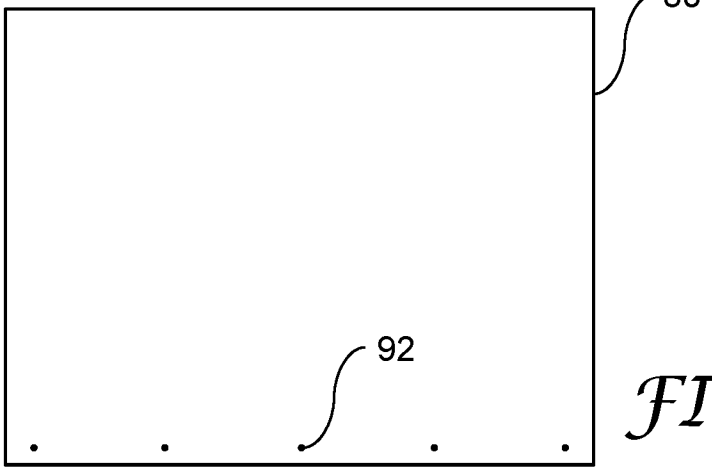
FIG. 11 shows an front elevation view of the apron board, which preserves and protects the ground adjacent to the excavated trench during trafficking and/or wheeled access.

FIGS. 10*a*, 10*b* and 10*c* are side, top and front views respectively of an apron clamp or connector 78 which can be used to support an apron board or groundmat 80 at one or both sides of the deployed apparatus 10 to preserve and protect the ground adjacent to the excavated trench during heavy trafficking and/or wheeled access. The apron clamp 78 is formed having a proximal end 82 having a slotted aperture 84 which spans the length of the clamp 78, as best shown in FIG. 10*a*. The clamp 78 also comprises an opposite distal end 86 which is formed as a U-shaped channel 88. A separate apron board or groundmat 80, as shown in FIG. 11, can be inserted into the U-shaped channel 88 and which is secured using thread fasteners (not shown) through apertures 90 on the clamp 78 and complementary apertures 92 on the apron board 80.

In use, the slotted apertures 84 meet with the elongate bar 42 running the length of the side panels 12*a*, 12*b*, such that the deployed apparatus 10 can be received inside the excavated trench and one or both apron boards or groundmats 80 extended from the sides of the apparatus 10 to cover the ground adjacent to the excavated trench to protect it during trafficking and/or wheeled access.

The materials forming the apron clamp 78 and groundmat 80 again being a recycled durable plastics material or the like.

Figure 13:
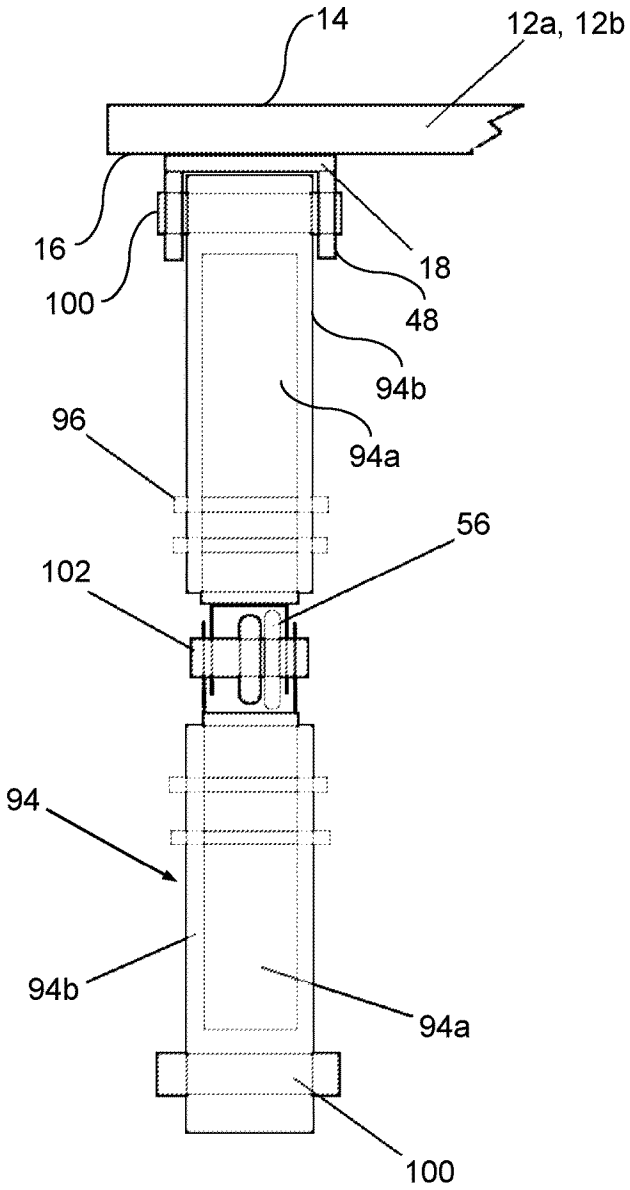
FIG. 13 shows an exploded top plan elevation view from above of the hinge mechanism shown in FIG. 12.

FIGS. 12 and 13 show a second embodiment of the trench shoring apparatus 10. The construction of the second embodiment is very similar to that of the first embodiment and corresponding features have been given the same reference numerals. The second embodiment differs from the first embodiment in that instead of hinge support plates 30*a*, 30*b* forming pairs of lateral arms which are pivotally connected to the connecting rod 50 to form the moving part of the hinge connection disposed between the first and second side panels 12*a*, 12*b*, the lateral arms forming the second embodiment of the invention comprise pairs of box-section adjustable arms or struts 94.

As perhaps best shown in FIG. 12, each adjustable strut 94 is elongate and formed from two complementary shaped struts 94*a*, 94*b*. The box-section inner strut 94*a* can be entirely received within the body of the box-section outer strut 94*b*. The adjustable strut 94 can be telescopically extended and retracted, and locked in position by locating an adjustment pin 96 in one of a plurality of apertures 98 which are formed in the inner lateral support strut 94*a* and outer lateral support strut 94*b*. In the embodiment shown in FIGS. 12 and 13, the pin 96 can be received inside the apertures 98 as a clearance or transition fit, although the skilled person will appreciate the other ways of locking the telescopically-adjustable strut 94 are possible.

Like the first embodiment of the invention, the moving part of the hinge mechanism provided by the lateral support struts 94*a*, 94*b* are disposed in pairs generally towards the top and near the middle of the trench shoring apparatus 10. The proximal end of each outer lateral support strut 94*b* is hingedly held in place using strut pins 100 that are disposed between each side face 48 of the C-section support member or backplate 18, as best shown in FIG. 13. The elongate adjustable strut 94 is comprised of a strut pin aperture 100*a* at the first support elongate member. The strut pin 100 is disposed through the strut pin aperture and the first support elongate member so as to permit pivotal movement of said elongate adjustable strut.

Each proximal end of the inner lateral support strut 94*a* is pivotally connected to the centrally-disposed connecting rod 50 via a center pin 102. The skilled person will appreciate that the distal end of each inner lateral support strut 94*a* is telescopically received within the distal end of the corresponding outer lateral support strut 94*b*, and can adjusted and locked in place, as described above. The elongate adjustable strut is comprised of a center pin aperture 102*a*.

The center pin 102 is disposed through the center pin aperture and the connecting rod so as to pivotally connect the connecting rod to the elongate adjustable strut.

In the embodiment shown in FIG. 12, the trench shoring apparatus 10 is depicted in an extended configuration such that the connecting rod 50 has been fully extended downwards in the direction denoted by arrow A and the outer surfaces 14 of the side panels 12*a*, 12*b* abut against the side walls of the excavated trench (not shown). In this configuration, the lowermost face 104 of each outer lateral support strut 94*b* abuts against triangular-shaped stopper plate 106 to limit over-rotation thereof. Whilst not intended to be limiting, each adjustable strut 94 is adjustable from around 600 mm to around 750 mm to around 900 mm using locating pins 96 inside apertures 98. In this way, the width of the trench that can be shored using apparatus 10 is between around 1.2 m to around 1.8 m. This range of trench width is encountered with most forms of residential, commercial and light industrial property construction and in earth excavations for the installation of pipelines, structures and water, drainage, sewerage, gas and other sub-surface utilities.

To limit the pivoting action of the adjustable strut 94 when the apparatus 10 is hoisted in the direction denoted by arrow B (FIG. 12) using lifting eye 56, the uppermost face 108 of the outer lateral support strut 94*b* contacts against a stop pin 110 is disposed in the side face 48 of the C-section support member or backplate 18. The skilled person will understand that the second embodiment of the invention can also be used having height-adjustable feet and also grille or supports to enable trafficking and it is also not intended to be limiting illustrating the second embodiment of the invention without these components. The second embodiment of the invention can also include a series of hoisting points 112 which can also be used to hoist the trench shoring apparatus 10.

The skilled person will appreciate that the side panels 12*a*, 12*b* can be formed from any number of synthetic plastics material, such as a thermoplastic or thermoset material, or any other suitable first or second generation plastics material. The above list is in no way intended to be limiting and exhaustive.

In a preferred embodiment, the panels 12*a*, 12*b* can be formed using Polypropylene (PP), High-Density Polyethylene (HDPE), Polyethylene Terephthalate (PET), Polyvinyl Chloride (PVC) or Acrylonitrile Butadiene Styrene (ABS) or blends thereof.

The skilled person will appreciate that different variations or densities of materials could also be provided which will allow for a generally low product weight which provides a good structural rigidity and durability. For safety and visibility, the panels 12*a*, 12*b* can be supplied in a number of different colours.

The skilled person will also appreciate that an additional advantage of the second embodiment of the present invention is an overall reduction in the weight of the apparatus 10. Because of stiction between the outer surfaces 14 of the side panels 12*a*, 12*b* and the side walls of the excavated trench when the apparatus 10 is deployed, the additional hoisting effort needed to hoist the initially stationary deployed apparatus 10 to break contact with the side walls of the excavated trench can be substantial, and a reduced apparatus 10 weight is highly desirable.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in the terms of a means for performing the disclosed function, or a method or process for attaining the disclosed result, as appropriate, separately, or in any combination of such features, can be utilised for realising the invention in diverse forms thereof.

The invention is not intended to be limited to the details of the embodiments described herein, which are described by way of example only. It will be understood that features described in relation to any particular embodiment can be featured in combination with other embodiments.

It is contemplated by the inventor that various substitutions, alterations, and modifications may be made to the invention without departing from the spirit and scope of the invention as defined by the claims. Examples of these include the following:

It is envisaged that rollers 70*a* or other support means can be positioned on the top edge 70 of the lower hinge plate 30*b* to support utilities or temporary pipework running therethrough.

I claim:

1. A trench shoring apparatus, comprising:

first and second side panels having a retracted parallel spaced-apart configuration and an extended parallel spaced-apart configuration;

a first pair of lateral arms, one first lateral arm of said first pair of lateral arms having one first lateral arm end hingedly connected to said first side panel, and another first lateral arm of said first pair of lateral arms having another first lateral arm end hingedly connected to said second side panel;

a second pair of lateral arms, one second lateral arm of said second pair of lateral arms having one second lateral arm end hingedly connected to said first side panel, and another second lateral arm of said second pair of lateral arms having another second lateral arm end hingedly connected to said second side panel; and a connecting rod having a fixed length between said first pair of lateral arms and said second pair of lateral arms and being pivotally connected to an opposite first lateral arm end of said one first lateral arm, another opposite first lateral arm end of said another first lateral arm, an opposite second lateral arm end of said one second lateral arm, and another opposite second lateral arm end of said another second lateral arm so as to move said first side panel and said second side panel between said retracted parallel spaced-apart configuration and said extended parallel spaced-apart configuration according to translational movement of said fixed length of said connecting rod along a direction parallel to said first side panel and said second side panel and along a longitudinal axis of said connecting rod.

2. The trench shoring apparatus, as in claim 1, wherein the first and second side panels are planar and each having an inner and outer surface, wherein the outer surfaces of the first and second side panels abut with the excavated sides of the trench when in use, wherein the inner surfaces of the first and second side panels are each connected to a plurality of elongate support members positioned from the top to the bottom of the side panels, and wherein the elongate support members are each secured to the inner surfaces of the first and second side panels using threaded fasteners which are received through apertures formed in the side panels and in the support members, said one first lateral arm end being hingedly connected to said first side panel at a respective elongate member secured to said first side panel, said another first lateral arm end being hingedly connected to said second side panel at a respective elongate member secured to said second side panel, said one second lateral arm end being hingedly connected to said first side panel at said respective elongate member secured to said first side panel, said another second lateral arm end being hingedly connected to said second side panel at said respective elongate member secured to said second side panel.

3. The trench shoring apparatus, as in claim 2, wherein the retracted configuration has a lateral dimension which is less than the width of the trench into which the apparatus is inserted when in use and which is less than the width of the extended configuration, and wherein the elongate support members form a fixed part of a hinge connection and having a square cross section with a pair of panels disposed either side thereof.

4. The trench shoring apparatus, as in claim 3, wherein said first and second side panels in said extended parallel spaced-apart configuration have outer surfaces so as to abut with the excavated sides of the trench when in use, wherein said one first lateral arm of said first pair of lateral arms is comprised of a first upper hinge plate, wherein said another first lateral arm of said first pair of lateral arms is comprised of a second upper hinge plate, wherein said one second lateral arm of said second pair of lateral arms is comprised of a first lower hinge plate, wherein said another second lateral arm of said second pair of lateral arms is comprised of a second lower hinge plate, wherein the upper and lower hinge plates are identical in size and shape, wherein the upper hinge plate is comprised of an elongated slot disposed along the top edge of the upper hinge plate, the slot securing a grille thereto using grille anchors, wherein the upper and lower hinge plates are each comprised of a proximal aperture for receiving an elongate bar running the length of the side panels to permit pivotal movement of the upper and lower hinge plates relative to the support members, and wherein the pivotal movement of the upper and lower hinge plates being only possible in an upward direction as a side edge of the upper and lower hinge plates abuts against the inner surface of the side panels preventing movement in a downward direction.

5. The trench shoring apparatus, as in claim 3, wherein said one first lateral arm of said first pair of lateral arms is comprised of a first upper hinge plate, wherein said another first lateral arm of said first pair of lateral arms is comprised of a second upper hinge plate, wherein said one second lateral arm of said second pair of lateral arms is comprised of a first lower hinge plate, wherein said another second lateral arm of said second pair of lateral arms is comprised of a second lower hinge plate, wherein the upper and lower hinge plates are identical in size and shape, wherein the upper hinge plate is comprised an elongated slot disposed along the top edge of the upper hinge plate so as to secure a grille thereto using grille anchors, wherein the upper and lower hinge plates are each comprised of a proximal aperture for receiving an elongate bar running the length of the side panels to permit pivotal movement of the upper and lower hinge plates relative to the support members, and wherein the pivotal movement of the upper and lower hinge plates being only possible in an upward direction as a side edge of the upper and lower hinge plates abuts against the inner surface of the side panels preventing movement in a downward direction.

6. The trench shoring apparatus, as in claim 3, further comprising:

a plurality of feet disposed at a bottom of the side panels, each of the feet having legs, each leg being received inside a respective cross section of a corresponding elongate support member, wherein the feet are adjustable in height by threaded fasteners being received through apertures in the legs and corresponding apertures in the corresponding elongate support members.

7. The trench shoring apparatus, as in claim 1, further comprising:

retrofittable extensions being placed on outer surfaces of the first and second side panels so as to extend lateral dimensions from the first side panel to the second side panel;

rollers being positioned on a top edge of said one first lateral arm so as to support utilities or temporary pipework running through the trench when in use; and connectors being compatible with corresponding fasteners on groundmats.

8. A method for supporting side walls of an excavated trench, the method comprising the steps of:

coupling a sling adjacent the connecting rod of a trench shoring apparatus, according to claim 1;

hoisting the apparatus so as to move said first and second side panels to the retracted spaced-apart configuration;

lowering the apparatus with the first and second side panels in the retracted spaced-apart configuration into the excavated trench; and pushing the connecting rod downwards so as to splay apart said first and second side panels to the extended parallel spaced-apart configuration and abut the apparatus against the side walls of the excavated trench.

9. A trench shoring apparatus, comprising:

a first side panel having a first top side panel edge, a first bottom side panel edge opposite said first top side panel edge, a first inner surface and a first outer surface opposite said first inner surface, said first side panel being planar;

a second side panel having a second top side panel edge, a second bottom side panel edge opposite said second top side panel edge, a second inner surface and a second outer surface opposite said second inner surface, said second side panel being planar, said first side panel being parallel to said second side panel, wherein said first side panel and said second side panel have a retracted parallel spaced-apart configuration and an extended parallel spaced-apart configuration, said first side panel being closer to said second side panel in said retracted parallel space-apart configuration than in said extended parallel spaced-apart configuration;

a first support elongate member being mounted on said first inner surface and extending from said first top side panel edge to said first bottom side panel edge, said first support elongate member being comprised of a cross section portion and a pair of first support elongate member panels on either side of said cross section portion;

a second support elongate member being mounted on said second inner surface and extending from said second top side panel edge to said second bottom side panel edge, said second support elongate member being comprised of a cross section portion and a pair of second support elongate member panels on either side of said cross section portion;

a pair of lateral arms, one lateral arm of said pair of lateral arms being hingedly connected to said first support elongate member on said first side panel, another lateral arm of said pair of lateral arms being hingedly connected to said second support elongate member on said second side panel;

a connecting rod being parallel to said first side panel and said second side panel, wherein said one lateral arm of said pair of lateral arms being pivotally connects to said connecting rod and said another lateral arm of said pair of lateral arms pivotally connects to said connecting rod so as to move said first side panel and said second side panel between said retracted parallel spaced-apart configuration and said extended parallel spaced-apart configuration according to translational movement of said connecting rod along a direction parallel to said first side panel and said second side panel and along a longitudinal axis of said connecting rod, wherein said one lateral arm of said pair of lateral arms is comprised of a first upper hinge plate, said first upper hinge plate being triangular and being positioned between said first top side panel edge and said first bottom side panel edge, and wherein said another lateral arm of said pair of lateral arms is comprised of a second upper hinge plate, said second upper hinge plate being triangular and being positioned between said second top side panel edge and said second bottom side panel edge; and another pair of lateral arms, one lateral arm of said another pair of lateral arms being hingedly connected to said first support elongate member on said first side panel, another lateral arm of said another pair of lateral arms being hingedly connected to said second support elongate member on said second side panel, wherein said one lateral arm of said another pair of lateral arms is comprised of a first lower hinge plate, said first lower hinge plate being triangular and being positioned between said first upper hinge plate and said first bottom side panel edge, and wherein said another lateral arm of said another pair of lateral arms is comprised of a second lower hinge plate, said second lower hinge plate being triangular and being positioned between said second upper hinge plate and said second bottom side panel edge.

10. The trench shoring apparatus, as in claim 9, wherein said first upper hinge plate is comprised of an elongated slot disposed along a top edge of said first upper hinge plate so as to secure a grille to said top edge with grille anchors.

11. The trench shoring apparatus, as in claim 9, wherein said first upper hinge plate is comprised of a proximal aperture, and wherein said first lower hinge plate is comprised of a proximal aperture, further comprising:

an elongate bar running through said first lower hinge plate at said proximal aperture and said first support elongate member and along a length of said first side panel.

12. The trench shoring apparatus, as in claim 9, further comprising:

an additional connecting rod;

a first additional pair of lateral arms, one lateral arm of said first additional pair of lateral arms being hingedly connected to said additional connecting rod, another lateral arm of said first additional pair of lateral arms being hingedly connected to said additional connecting rod; and a second additional pair of lateral arms, one lateral arm of said second additional pair of lateral arms being hingedly connected to said additional connecting rod, another lateral arm of said second additional pair of lateral arms being hingedly connected to said additional connecting rod.

13. The trench shoring apparatus, as in claim 12, wherein said connecting rod is comprised of an elongate rod having an end with an end aperture and an opposite end with an opposite end aperture, wherein said additional connecting rod is comprised of an additional elongate rod having an end with an end aperture and an opposite end with an opposite end aperture, wherein said first upper hinge plate is comprised of a distal aperture, wherein said first lower hinge plate is comprised of a distal aperture, further comprising:

a top spacer bar running through said first upper hinge plate at said distal aperture of said first upper hinge plate and said end aperture; and another elongate bar running through said first lower hinge plate at said distal aperture of said first lower hinge plate and said opposite end aperture.

14. The trench shoring apparatus, as in claim 13, wherein said first upper hinge plate is comprised of an elongated slot disposed along a top edge of said first upper hinge plate so as to secure a grille to said top edge with grille anchors, further comprising:

at least two hoisting loops disposed along said top spacer bar so as to be received within grill slots disposed in the grille.

15. The trench shoring apparatus, as in claim 9, further comprising:

rollers being positioned on a top edge of said first lower hinge plate so as to support utilities or temporary pipework running through the trench when in use.

16. The trench shoring apparatus, as in claim 9, further comprising:

a first alternative additional pair of lateral arms, one lateral arm of said first alternative additional pair of lateral arms being hingedly connected to said first support elongate member on said first side panel, another lateral arm of said first alternative additional pair of lateral arms being hingedly connected to said second support elongate member on said second side panel, wherein said one lateral arm of said first alternative additional pair of lateral arms is comprised of an elongate adjustable strut being disposed towards said first top side panel edge, and wherein said another lateral arm of said first alternative additional pair of lateral arms is comprised of a complementary shaped elongate adjustable strut being disposed toward said second top side panel edge; and a second alternative additional pair of lateral arms, one lateral arm of said second alternative additional pair of lateral arms being hingedly connected to said connecting rod, another lateral arm of said second alternative additional pair of lateral arms being hingedly connected to said connecting rod wherein said one lateral arm of said second alternative additional pair of lateral arms is comprised of an elongate adjustable strut being disposed between said one lateral arm of said first alternative additional pair of lateral arms and said first bottom side panel edge, and wherein said another lateral arm of said second alternative additional pair of lateral arms is comprised of a complementary shaped elongate adjustable strut being disposed between said another lateral arm of said second alternative additional pair of lateral arms and said second bottom side panel edge.

17. The trench shoring apparatus as claimed in claim 16, wherein said elongate adjustable strut is comprised of a strut pin aperture at said first support elongate member, further comprising:

a strut pin being disposed through said strut pin aperture and said first support elongate member so as to permit pivotal movement of said elongate adjustable strut.

18. The trench shoring apparatus as claimed in claim 17, wherein said elongate adjustable strut is comprised of a center pin aperture, further comprising:

a center pin being disposed through said center pin aperture and said connecting rod so as to pivotally connect said connecting rod to said elongate adjustable strut.

19. The trench shoring apparatus as claimed in claim 16, wherein said connecting rod is disposed between said first alternative additional pair of lateral arms, and wherein said connecting rod is disposed between said second alternative additional pair of lateral arms.

20. A trench shoring apparatus, comprising:

a first side panel having a first top side panel edge, a first bottom side panel edge opposite said first top side panel edge, a first inner surface and a first outer surface opposite said first inner surface, said first side panel being planar;

a second side panel having a second top side panel edge, a second bottom side panel edge opposite said second top side panel edge, a second inner surface and a second outer surface opposite said second inner surface, said second side panel being planar, said first side panel being parallel to said second side panel, wherein said first side panel and said second side panel have a retracted parallel spaced-apart configuration and an extended parallel spaced-apart configuration, said first side panel being closer to said second side panel in said retracted parallel space-apart configuration than in said extended parallel spaced-apart configuration;

a first support elongate member being mounted on said first inner surface and extending from said first top side panel edge to said first bottom side panel edge, said first support elongate member being comprised of a cross section portion and a pair of first support elongate member panels on either side of said cross section portion;

a second support elongate member being mounted on said second inner surface and extending from said second top side panel edge to said second bottom side panel edge, said second support elongate member being comprised of a cross section portion and a pair of second support elongate member panels on either side of said cross section portion;

a pair of lateral arms, one lateral arm of said pair of lateral arms being hingedly connected to said first support elongate member on said first side panel, another lateral arm of said pair of lateral arms being hingedly connected to said second support elongate member on said second side panel;

a connecting rod being parallel to said first side panel and said second side panel, wherein said one lateral arm of said pair of lateral arms being pivotally connects to said connecting rod and said another lateral arm of said pair of lateral arms pivotally connects to said connecting rod so as to move said first side panel and said second side panel between said retracted parallel spaced-apart configuration and said extended parallel spaced-apart configuration according to translational movement of said connecting rod along a direction parallel to said first side panel and said second side panel and along a longitudinal axis of said connecting rod; and a plurality of feet disposed below said first bottom side panel edge and said second bottom side panel edge, one foot of said plurality of feet being comprised of a leg, said leg being slideably received inside said cross section portion of said first support elongate member.

* * * * *